United States Patent [19]

Thompson

[11] Patent Number: 4,989,678

[45] Date of Patent: Feb. 5, 1991

[54] SOIL SAMPLING KIT AND A METHOD OF SAMPLING THEREWITH

[75] Inventor: Cyril V. Thompson, Knoxville, Tenn.

[73] Assignee: Martin Marietta Energy Systems, Inc., Oak Ridge, Tenn.

[21] Appl. No.: 445,301

[22] Filed: Dec. 1, 1989

[51] Int. Cl.[5] ..... E21B 25/10

[52] U.S. Cl. ..... 175/20; 175/58; 175/249; 175/321; 73/864.44

[58] Field of Search ..... 175/20, 58, 244, 249, 175/321, 403; 73/864.44, 864.45, 864.91

[56] References Cited

U.S. PATENT DOCUMENTS

| | | | |
|---|---|---|---|
| D. 269,844 | 7/1983 | Hackerson | D8/7 |
| 3,075,588 | 1/1963 | Mitchell | 175/20 |
| 3,236,531 | 2/1966 | McConnell | 277/116.4 |
| 3,326,049 | 6/1967 | Eley | 73/429 |
| 3,444,938 | 5/1969 | Ballmann | 73/864.44 |
| 3,464,732 | 9/1969 | Woodward | 294/19 |
| 3,497,018 | 2/1970 | Shultz et al. | 175/6 |
| 3,690,389 | 9/1972 | Van De Beld et al. | 175/59 |
| 3,696,873 | 10/1972 | Anderson | 175/20 |
| 4,549,612 | 10/1985 | Cushing | 175/58 |
| 4,556,114 | 12/1985 | Ryan | 175/20 |
| 4,848,484 | 7/1989 | Clements | 175/20 |

OTHER PUBLICATIONS

EPA Sample Acquisition Method, Chapter Four Organic Analytes, pp. Four-1-6, Sept. 1986.

EPA Method 5030 Purge-and-Trap, pp. 5030-1-21, Sept. 1986.

Cyril V. Thompson, Marsha D. Edwards, Michael P. Maskarinec, "A New Method for the Sampling and Analysis of Volatile Organics in Soils", Oral Presentation on Oct. 12, 1989, at 31st Ornl-Doe Conference on Analytical Chemistry and Energy Technology in Gatlinberg, Tennessee.

*Primary Examiner*—Ramon S. Britts
*Assistant Examiner*—Terry Lee Melius
*Attorney, Agent, or Firm*—Ivan L. Ericson; Bruce M. Winchell

[57] ABSTRACT

A soil sampling device and a sample containment device for containing a soil sample is disclosed. In addition, a method for taking a soil sample using the soil sampling device and soil sample containment device to minimize the loss of any volatile organic compounds contained in the soil sample prior to analysis is disclosed. The soil sampling device comprises two close fitting, longitudinal tubular members of suitable length, the inner tube having the outward end closed. With the inner closed tube withdrawn a selected distance, the outer tube can be inserted into the ground or other similar soft material to withdraw a sample of material for examination. The inner closed end tube controls the volume of the sample taken and also serves to eject the sample. The soil sample containment device has a sealing member which is adapted to attach to an analytical apparatus which analyzes the volatile organic compounds contained in the sample. The soil sampling device in combination with the soil sample containment device allow an operator to obtain a soil sample containing volatile organic compounds and minimizing the loss of the volatile organic compounds prior to analysis of the soil sample for the volatile organic compounds.

17 Claims, 9 Drawing Sheets

SOIL SAMPLING KIT AND A METHOD OF SAMPLING THEREWITH

The Department of Energy (DOE) has rights in this invention pursuant to Contract No. DE-AC05-84OR21400.

FIELD OF THE INVENTION

This invention relates to a sampling kit and a method of sampling therewith. More particularly, this invention relates to a soil sampling kit and a method of sampling soil therewith.

BACKGROUND OF THE INVENTION

The Environmental Protection Agency (EPA) and other Government agencies have concentrated efforts to clean up the environment. The clean up efforts require mapping of locations where hazardous materials have been dumped and determining the concentrations and extent of contamination. One method of determining the concentrations and extent of the contamination caused by hazardous materials is by sampling the soil in the suspect areas.

Many of the hazardous materials contained in the contaminated soil are volatile organic compounds. A major problem in the soil sampling procedures currently being used is the loss of the volatile organic compounds contained in the soil prior to the analysis of the soil sampled.

The patent literature contains many soil sampling devices such as : U.S. Pat. No. 3,075,588 to Mitchell, U.S. Pat. No. 3,326,049 to Eley, U.S. Pat. No. 3,463,732 to Woodward, U.S. Pat. No. 3,497,018 to Shultz et al., U.S. Pat. No. 3,690,389 to Van De Beld et al., U.S. Pat. No. 3,696,873 to Anderson, U.S. Pat. No. 4,549,612 to Cushing, U.S. Pat. No. 4,556,114 to Ryan, and U.S. Pat. Des. Nos. 269,844. However, these devices do not solve the problem of losing volatile organic compounds prior to the analysis of a sample of contaminated soil.

The present invention provides a soil sampling kit and a method for sampling the soil utilizing the soil sampling kit to minimize the loss of volatile organic compounds prior to the analysis of the soil sample.

SUMMARY OF THE INVENTION

In accordance with one aspect of the present invention, a new and improved soil sampling kit comprises a soil sampling device in combination with a soil sample containment device. The soil sampling device comprises an outer longitudinal tubular member, an inner longitudinal tubular member, a first positioning member, and a second positioning member. The outer longitudinal tubular member has an upper end and a lower end. The inner longitudinal tubular member has an upper end and a lower end. The inner longitudinal tubular member is located within the outer longitudinal tubular member and adapted to slide longitudinally within the outer longitudinal tubular member. The lower end of the inner longitudinal tubular member has a plate attached thereto forming a flat surface essentially perpendicular to the inner longitudinal tubular member. The upper end of the inner longitudinal tubular member extends outside of the outer longitudinal tubular member.

The first positioning member is perpendicularly connected to the upper end of the inner longitudinal tubular member and the second positioning member is perpendicularly connected to the upper end of the outer longitudinal tubular member. The second positioning member is essentially parallel to the first positioning member. The first positioning member and the second positioning member are adapted to position the inner longitudinal tubular member within the outer longitudinal tubular member to form a cavity within the outer longitudinal tubular member for receiving a sample of soil. The cavity forms an adjustably predetermined volume. The first positioning member is connected to the second positioning member by an adjustable guiding member having a biasing element coacting therewith. The soil sample containment device comprises a container and a sealing member. The container has a first end. The first end of the container has an opening. The first end of the container is adapted to receive the sealing member. The sealing member is adapted to receive a probe from an analytical device without removing the sealing means from the container.

In accordance with another aspect of the present invention, a new and improved method of obtaining a sample of soil containing a volatile organic compound comprises the following steps:

Step 1. The surface of a predetermined area of ground is penetrated to a predetermined depth with a soil sampling device to obtain a sample of soil from the ground.

Step 2. The soil sampling device containing a predetermined volume of the sample of soil is removed from the ground.

Step 3. The sample of soil from the soil sampling device is discharged into a soil sample containment device minimizing the time the sample of soil is removed from the ground and discharged into the soil sample containment device to minimize any loss of the volatile organic compound contained in the soil sample.

Step 4. The soil sample containment device containing the soil sample is sealed with a sealing member minimizing the time the sample of soil is discharged into the soil sample containment device and the soil sample containment device is sealed to minimize any loss of the volatile organic compound contained in the soil sample.

Step 5. The soil sample containment device containing the soil sample is attached to an analytical device without losing the volatile organic compound contained in the soil sample.

Step 6. The volatile organic compound is removed from the soil sample.

Step 7. The volatile organic compound which was removed from the soil sample is analyzed.

Figure 1:
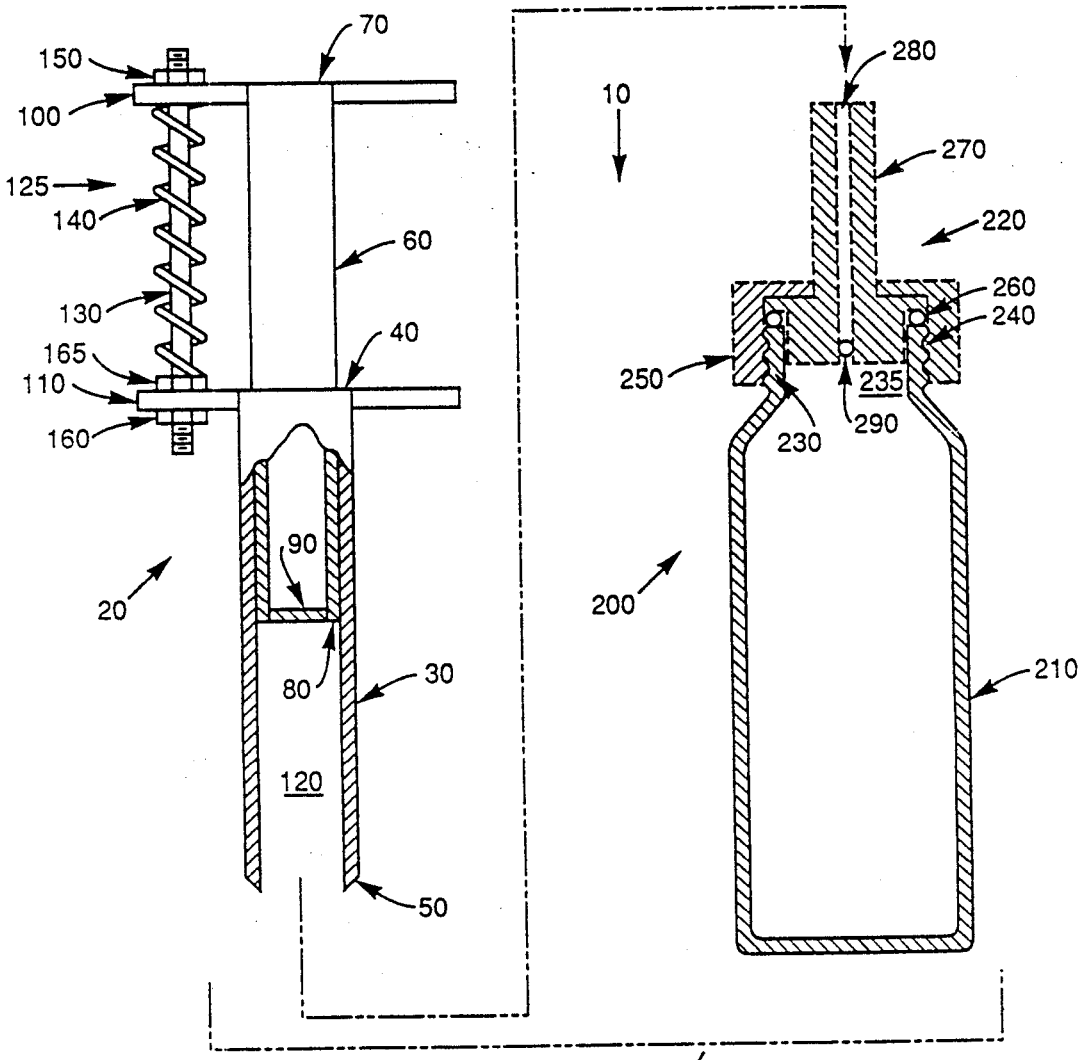
FIG. 1 is a partical cross sectional view of a soil sampling kit comprising a soil sampling device in combination with a soil sample containment device in accordance with the present invention.

For a better understanding of the present invention, together with other and further objects, advantages and capabilities thereof, reference is made to the following disclosure and appended claims in connection with the above-described drawing.

DETAILED DESCRIPTION OF THE PREFERRED EMBODIMENTS

The present invention minimizes the time it takes to sample contaminated ground and seal the soil sample within a container thereby minimizing the loss of volatile organic compounds contained within the soil sample prior to analysis of the soil sample.

The soil sampling device was made from two commercial cork borers one being smaller than the other. The smaller cork borer slides within the larger. The smaller cork borer was sealed off at one end to act as a plunger when inserted into the larger cork borer. A threaded rod was attached to one of the handles of the large cork borer which had a hole drilled into it to receive the threaded rod. The threaded rod was secured to the handle of the large cork borer with two nuts. A hole was drilled into one of the handles of the small cork borer to receive the end of the threaded rod not attached to the handle of the large cork borer. The handle of the small cork borer could freely slide along the threaded rod. A nut acting as an adjustable stop was attached to the end of the threaded rod which extended through the hole in the handle of the smaller cork borer. A spring was placed over the threaded rod and positioned between the handle of the large cork borer and the handle of the small cork borer to provide a bias.

The soil sample containment device used to hold the soil sample while the soil sample was taken from the contaminated area to the place where it was to be analyzed for the volatile organic compounds contained therein was a glass sample vial and cap containing a probe receiving member. This device was obtained from a commercial source, Associated Design and Manufacturing Company, 814 North Henry Street, Alexandria, Va.

A technician took soil samples by taking the soil sampling kit comprising the soil sampling device and the soil sample containment device into the contaminated area. The technician previously determined the proper setting of the adjustable soil sampling device to obtain a desired sample weight by adjusting the adjusting nut on the threaded rod which positioned the small cork borer within the large cork borer creating a cavity having a specific volume within the large cork borer for each setting of the adjusting nut. While holding the sample vial in one hand the technician pushed the soil sampling device into the ground penetrating the ground at a predetermined location forcing a sample of soil into the cavity of the large cork borer. The technician then rapidly removed the soil sampling device containing the soil sample and quickly discharged the soil sample into the sample vial by pushing the handle of the small cork borer with his or her thumb to discharge the soil sample from the cavity of the large cork borer into the sample vial. The technician then quickly sealed the sample vial with the threaded cap containing the probe receiving member. The complete procedure took less than five seconds. The soil sample was then taken to the laboratory for analysis. The probe from a heated purge-and-trap assembly was inserted into the aperture of the probe receiving member dislodging the reseatable plug contained within the aperture thereby accessing the inside of the glass vial and the soil sample with the probe. The soil sample was then purged of any volatile organic compounds and the volatile organic compounds were then run through a gas chromatograph and analyzed by a mass spectrometer.

Referring now to the drawing with greater particularity, there is shown in FIG. 1 soil sampling kit 10 comprising soil sampling device 20 in combination with soil sample containment device 200. Soil sampling device 20 comprises outer longitudinal tubular member 30, inner longitudinal tubular member 60, first positioning member 100, and second positioning member 110. Outer longitudinal tubular member 20 has a upper end 40 and a lower end 50. Inner longitudinal tubular member 60 has an upper end 70 and a lower end 80. Inner longitudinal tubular member 60 is located within outer longitudinal tubular member 30 and adapted to slide longitudinally within outer longitudinal tubular member 30. Lower end 80 of inner longitudinal tubular member 60 has a plate 90 attached thereto forming a flat surface essentially perpendicular to inner longitudinal tubular member 60. Upper end 70 of the inner longitudinal tubular member 60 extends outside of outer longitudinal tubular member 30. First positioning member 100 is perpendicularly connected to upper end 70 of inner longitudinal tubular member 60 and second positioning member 110 is perpendicularly connected to the upper end 40 of outer longitudinal tubular member 30. Second positioning member 110 is essentially parallel to first positioning member 100. First positioning member 100 and second positioning member 110 are adapted to position inner longitudinal tubular member 60 within outer longitudinal tubular member 30 to form cavity 120 within outer longitudinal tubular member 30 for receiving a sample of soil. Cavity 120 forms an adjustable predetermined volume. First positioning 110 by adjustable guiding member 125 having biasing element 140, such as a spring, coacting therewith. Adjustable guiding member 125 comprises threaded rod 130 having fasteners, such as nuts 150, 160 and 165, attached at adjustable positions along threaded rod 130 to provide preset positioning of first positioning member 100 with respect to second positioning member 110. First positioning member 100 and second positioning member coact with inner longitudinal tubular member 60 and outer longitudinal tubular member 30 respectively to form cavity 120 within the outer longitudinal tubular member 30 having a predetermined volume.

Figure 9:
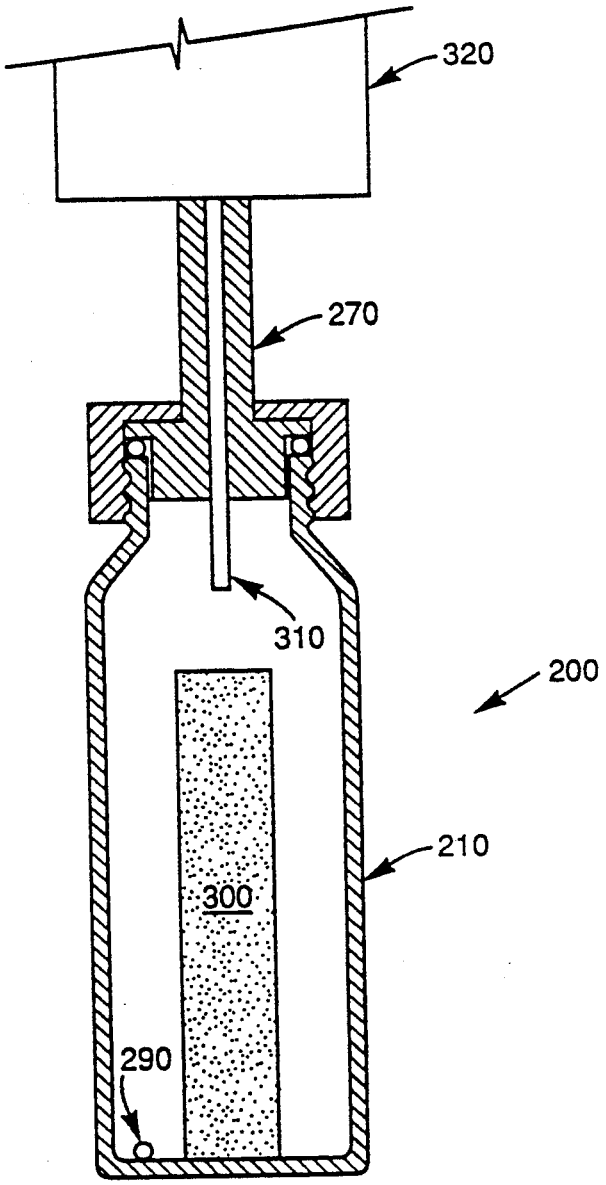
FIG. 9 is a partical cross sectional view of the soil sample containment device of FIG. 8 attached to an analytical device in accordance with the present invention.

Soil sample containment device 200 comprises container 210, such as a glass vial, and sealing member 220. Container 210 has first end 230. First end 230 of container 210 has an opening 235. First end 230 of container 210 is adapted, such as threads 240, to receive sealing member 220. Sealing member 220 comprises threaded cap 250 adapted to contain probe receiving member 270. Threaded cap 250 coacts with threads 240 of container 210 to hold probe receiving means 270 against ring seal 260 to seal container 210. Probe receiving member 270 coacts with threaded cap 250 and ring seal 260 which also coacts with first end 230 of container 210 to form sealed soil sample containment device 200 shown in FIG. 1. Probe receiving member 270 has aperture 280 for receiving probe 310 of analytical device 320, shown in FIG. 9. Aperture 280 contains reseatable removable plug 290 which is removed by probe 270, shown in FIG. 9, when probe 270 is inserted into aperture 280 of probe receiving member 270 to access the inside of container 210 containing the sample of soil 300. Sealing member 220 is adapted to receive probe 310 from analytical device 320 without removing sealing member from container 210 as shown in FIG. 9.

Figure 2:
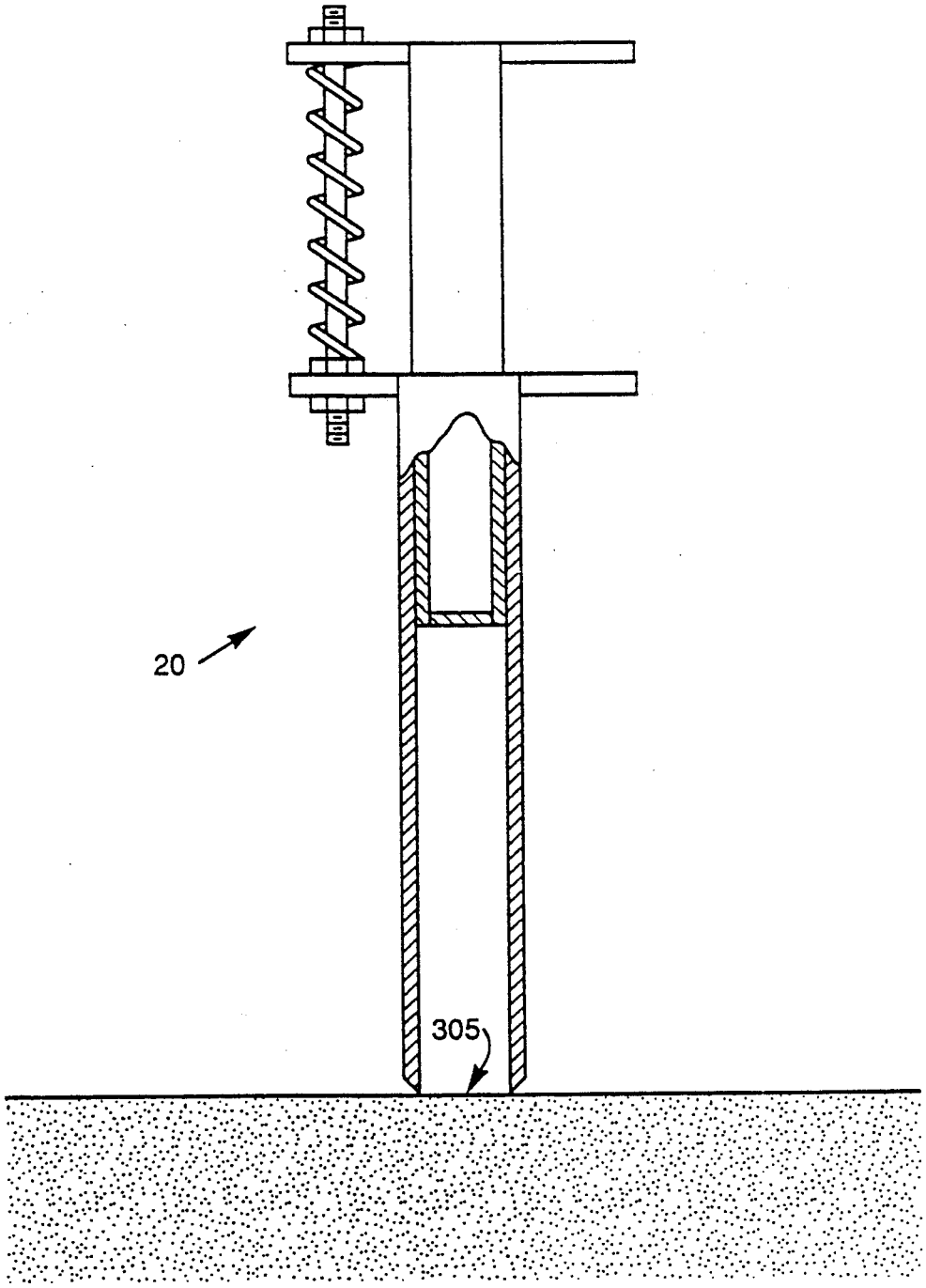
FIG. 2 is a partical cross sectional view of the soil sampling device in FIG. 1 positioned above the ground prior to taking a sample in accordance with the present invention.
Figure 3:
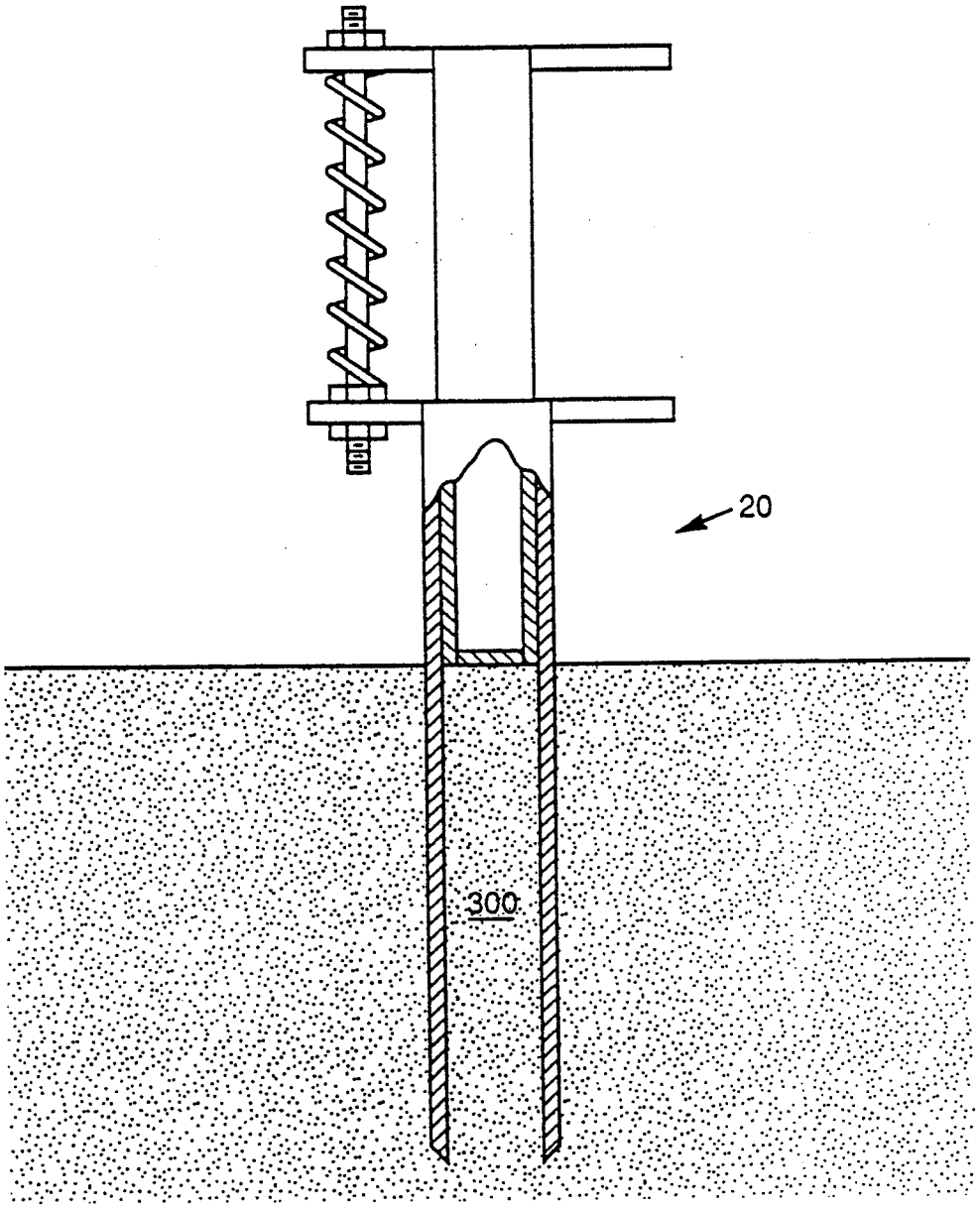
FIG. 3 is a partical cross sectional view of the soil sampling device in FIG. 1 after being positioned into the ground for taking a sample in accordance with the present invention.
Figure 4:
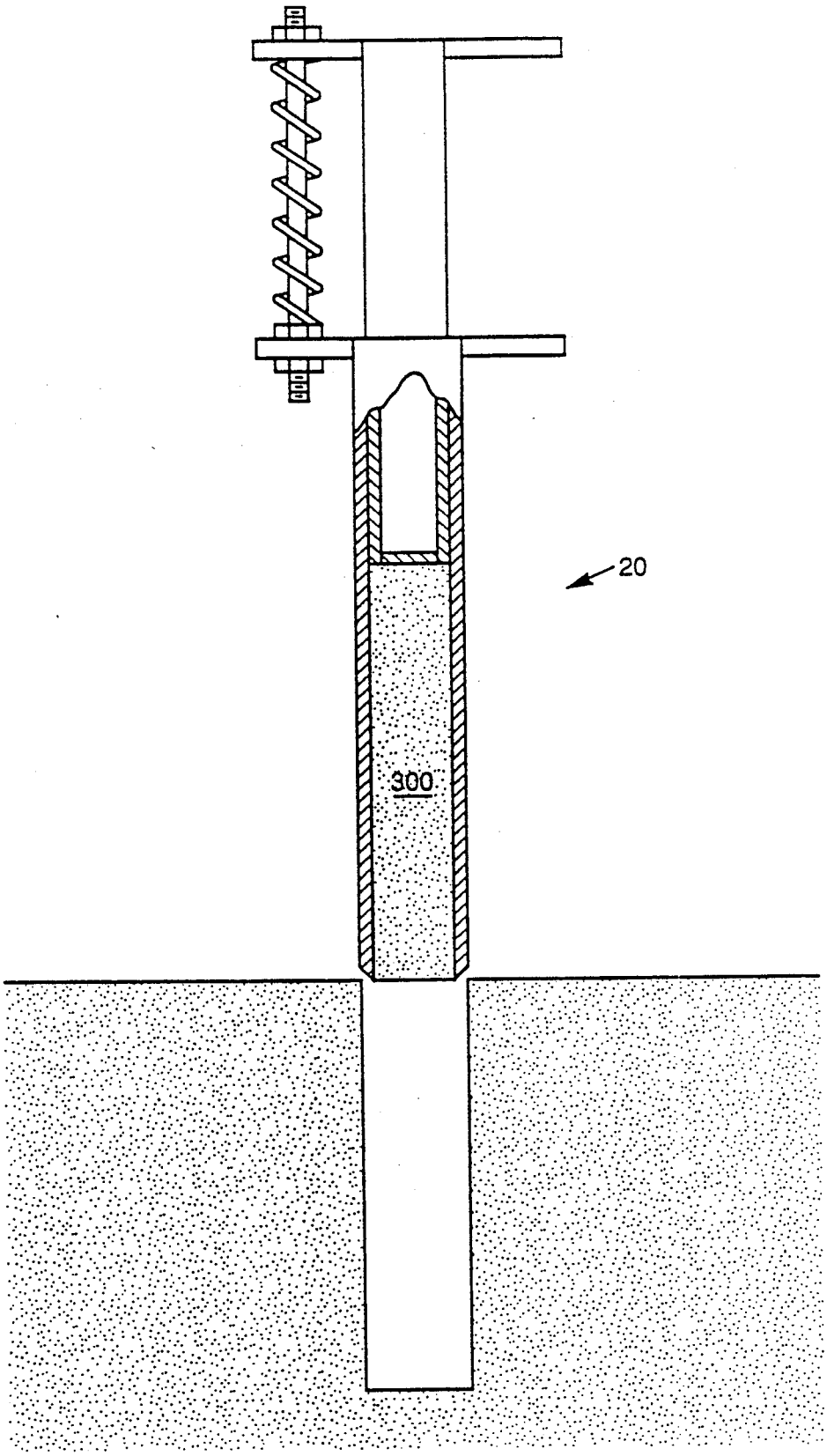
FIG. 4 is a partical cross sectional view of the soil sampling device in FIG. 1 after being removed from the ground with a sample of soil contained therein in accordance with the present invention.
Figure 5:
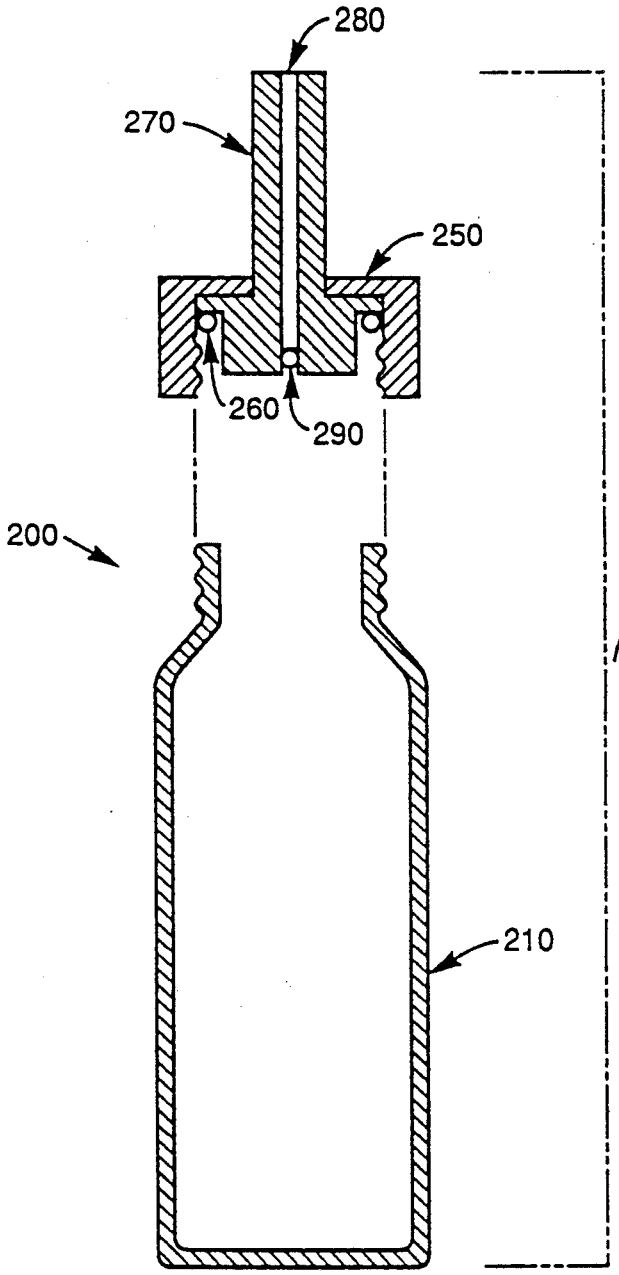
FIG. 5 is a cross sectional view of the soil sample containment device in FIG. 1 with the sealing member removed in accordance with the present invention.
Figure 6:
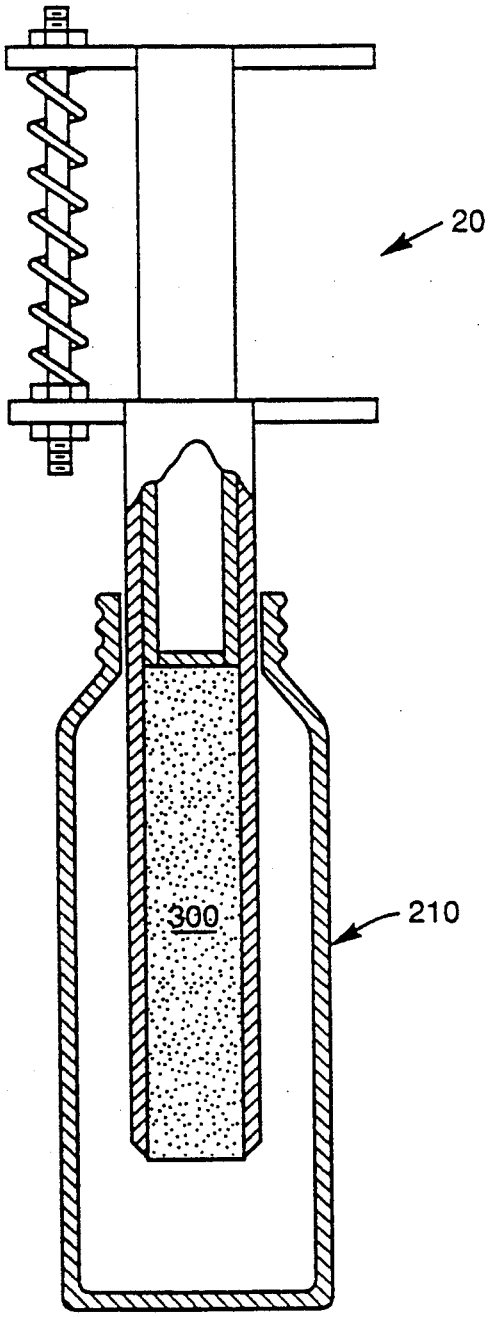
FIG. 6 is a partical cross sectional view of the soil sampling device of FIG. 4 being positioned in soil sample containment device of FIG. 5 in accordance with the present invention.
Figure 7:
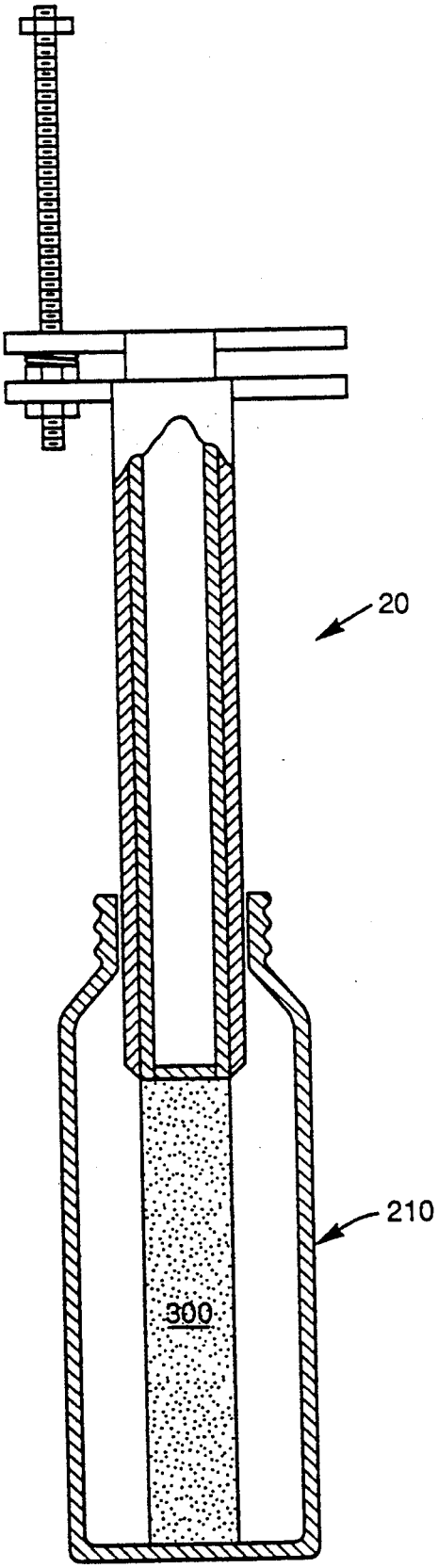
FIG. 7 is a partical cross sectional view of the soil sampling device of FIG. 6 after soil sample is ejected therefrom into soil sample containment device of FIG. 5 in accordance with the present invention.

A method for obtaining a sample of soil for analysis from ground contaminated with volatile organic compounds comprises taking soil sampling kit 10, shown in FIG. 1, into the field to a predetermined area of ground which is to be sampled. The surface of predetermined area of ground 305, shown in FIG. 2, is penetrated to a predetermined depth with soil sampling device 20, shown in FIG. 3, to obtain a sample of soil 300 from the ground. Soil sampling device 20 containing a predetermined volume of soil 300 is quickly removed from the ground as shown in FIG. 4. The sample of soil 300 from the soil sampling device 20 is transferred into soil sample containment device 200, shown in FIGS. 5, 6, and 7 as quickly as possible to minimizing the time the sample of soil 300 is removed from the ground and discharged into soil sample containment device 200 to minimize any loss of the volatile organic compound contained in the soil sample 300.

Figure 8:
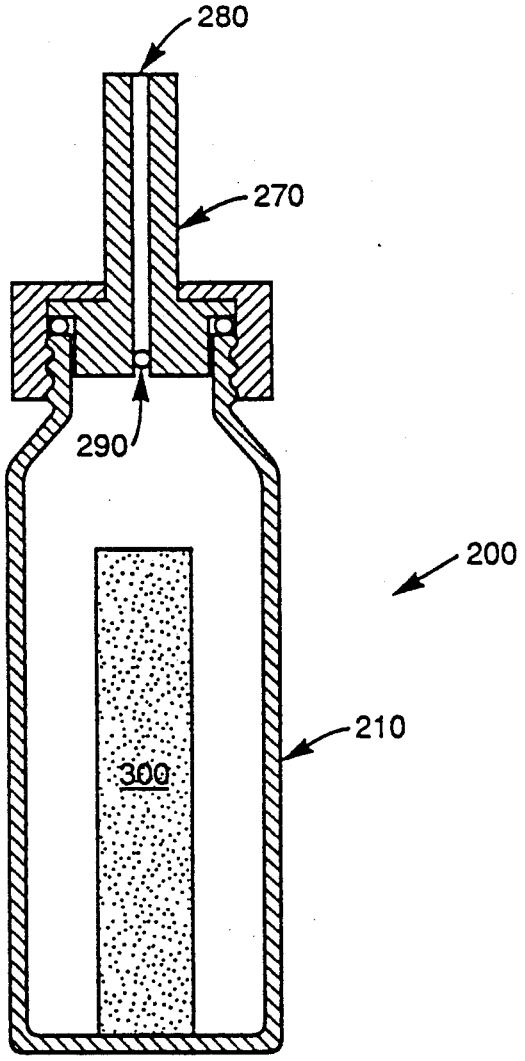
FIG. 8 is a cross sectional view of the soil sample containment device of FIG. 5 sealed and containing a sample of soil in accordance with the present invention.

Soil sample containment device 200 containing the soil sample 300 is quickly sealed with a sealing member 220, shown in FIG. 8, minimizing the time the sample of soil 300 is discharged into soil sample containment device 200 and to minimize any loss of the volatile organic compound contained in the sample of soil 300. This sampling, transfering, and sealing can be accomplished within five seconds or less.

Soil sample containment device 200 containing the sample of soil 300 is attached to analytical device 320 without losing the volatile organic compound contained in the sample of soil 300. When soil sample containment device 200 containing the sample of soil 300 is attached to analytical device 320, probe 310 is inserted into aperture 280 of probe receiving member 270 containing reseatable removable plug 290 which is seated in aperture 280, shown in FIG. 8, and dislodges plug 290, as shown in FIG. 9.

The volatile organic compound is removed from the sample of soil 300 and the volatile organic compound which was removed from the sample of soil 300 is analyzed.

The present invention has several distinguishing features:

1. The soil sampling device can be operated with one hand. This is important in the procurement of a soil sample which must be quickly placed in a soil sample containment device to minimize loss of volatile organic compounds contained in the soil sample. The soil sample containment device can be held in one hand while the soil sampling device is operated with the other.

2. The soil sampling device can be operated very quickly. The sample acquisition and transfer time to the soil sample containment device is on the order of five seconds or less.

3. The volume of sample taken can be adjusted in very fine increments, allowing for differences in soil density to provide a predetermined weight for each soil sample taken.

4. The sample can be discharged from the soil sampling device into the soil sample containment device easily and quickly by the operator depressing the positioning member with his or her thumb without removing the soil sampling device from his or her hand and still hold the soil sample containment device in the other hand ready to receive the soil sample.

5. The majority of the soil sample is enclosed within the soil sampling device for the brief period between sample acquisition and placement of the sample in the soil sampler containment device.

6. The components of the soil sampling kit are easily disassembled and cleaned.

7. The soil sampling device is inexpensive to make.

8. The soil sampling kit is portable and is easy to use in the field.

While there has been shown and described what is at present considered the preferred embodiment of the invention, it will be obvious to those skilled in the art that various changes and modifications may be made therein without departing from the scope of the invention as defined by the appended claims.

What is claimed is:

1. A soil sampling kit comprising a soil sampling means in combination with a soil sample containment means;

said soil sampling means comprising an outer longitudinal tubular member having an upper end and a lower end;

an inner longitudinal tubular member having an upper end and a lower end, said inner longitudinal tubular member being located within said outer longitudinal tubular member and being adapted to move longitudinally within said outer longitudinal tubular member, said lower end of said inner longitudinal tubular member having a plate attached thereto forming a flat surface essentially perpendicular to said inner longitudinal tubular member, said upper end of said inner longitudinal tubular member extending outside of said outer longitudinal tubular member;

a first positioning means perpendicularly connected to said upper end of said inner longitudinal tubular member; and a second positioning means perpendicularly connected to said upper end of said outer longitudinal tubular member, said second positioning means being essentially parallel to said first positioning means, said first positioning means and said second positioning means being adapted to position said inner longitudinal tubular member within said outer longitudinal tubular member to form a cavity within said outer longitudinal tubular member for receiving a sample of soil, said cavity forming an adjustably predetermined volume, said first positioning means being connected to said second positioning means by an adjustable guiding member having a biasing element coacting therewith;

said soil sample containment means comprising a container and a sealing means; said container having a first end, said first end of said container having an opening, said first end of said container being adapted to receive said sealing means, said sealing means being adapted to receive a probe from an analytical device without removing said sealing means from said container.

2. A soil sampling kit in accordance with claim 1 wherein said adjustable guiding member comprises a threaded rod having fasteners attached at adjustable positions along said threaded rod to provide preset positioning of said first positioning means with respect to said second positioning means, said first positioning means and said second positioning means coacting with said inner longitudinal tubular member and said outer longitudinal tubular member respectively to form a cavity within said outer longitudinal tubular member having a predetermined volume.

3. A soil sampling kit in accordance with claim 1 wherein said biasing element is a spring.

4. A soil sampling kit in accordance with claim 2 wherein said fasteners comprise nuts.

5. A soil sampling kit in accordance with claim 1 wherein said container comprises a glass vial.

6. A soil sampling kit in accordance with claim 1 wherein said first end of said container has threads for receiving and securing said sealing means.

7. A soil sampling kit in accordance with claim 1 wherein said sealing means comprises a threaded cap adapted to contain a probe receiving means, said threaded cap coacts with said container to hold said probe receiving means against a ring seal to seal said container.

8. A soil sampling kit in accordance with claim 7 wherein said probe receiving means has an aperture for receiving a sampling probe from an analytical instrument, said aperture contains a reseatable removable plug.

9. A soil sampling kit in accordance with claim 1 wherein said sealing means has a ring seal coacting with said first end of said container and said probe receiving means to form a seal.

10. A method of obtaining a sample of soil containing a volatile organic compound comprising the following steps:

Step 1. penetrating the surface of a predetermined area of ground to a predetermined depth with a soil sampling device to obtain a sample of soil from said ground, said soil sampling device comprises an outer longitudinal tubular member having an upper end and a lower end; an inner longitudinal tubular member having an upper end and a lower end, said inner longitudinal tubular member being located within said outer longitudinal tubular member and being adapted to move longitudinally within said outer longitudinal tubular member, said lower end of said inner longitudinal tubular member having a plug attached thereto forming a flat surface essentially perpendicular to said inner longitudinal tubular member, said upper end of said inner longitudinal tubular member extending outside of said outer longitudinal tubular member; a first positioning means perpendicularly connected to said upper end of said inner longitudinal tubular member; and a second positioning means perpendicularly connected to said upper end of said outer longitudinal tubular member, said second positioning means being essentially parallel to said first positioning means, said first positioning means and said second positioning means being adapted to position said inner longitudinal tubular member within said outer longitudinal tubular member to form a cavity within said outer longitudinal tubular member for receiving a sample of soil, said cavity forming an adjustably predetermined volume, said first positioning means being connected to said second positioning means by an adjustable guiding member having a biasing element coating therewith;

Step 2. removing said soil sampling device containing a predetermined volume of said sample of soil from said ground;

Step 3. discharging said sample of soil from said soil sampling device into a soil sample containment means minimizing the time said sample of soil is removed from said ground discharged into said soil sample containment device to minimize and loss of said volatile organic compound contained in said soil sample;

Step 4. sealing said soil sample containment means containing said soil sample with a sealing means minimizing the time said sample of soil is discharged into said soil sample containment means and said soil sample containment means is sealed to minimize any loss of said volatile organic compound contained in said soil sample;

Step 5. attaching said soil sample containment means containing said soil sample to an analytical device without losing said volatile organic compound contained in said soil sample;

Step 6. removing said volatile organic compound from said soil sample; and

Step 7. analyzing said volatile organic compound removed from said soil sample.

11. A method of obtaining a sample of soil containing a volatile organic compound in accordance with claim 10 wherein said soil sample containment device comprises a container and a sealing means; said container having a first end, said first end of said container having an opening, said first end of said container being adapted to receive said sealing means, said sealing means being adapted to receive a probe from an analytical device without removing said sealing means from said container.

12. A method of obtaining a sample of soil containing a volatile organic compound in accordance with claim 10 wherein said time said sample of soil is removed from said ground a discharged into said soil sample containment device in Step 3 and said time said sample of soil is discharged into said soil sample containment means and said soil sample containment means is sealed in step 4 totals less than five seconds.

13. A method of obtaining a sample of soil containing a volatile organic compound in accordance with claim 10 wherein said analytical device comprises a heated purge-and-trap assembly in conjunction with a gas chromatograph and a mass spectrometer.

14. A soil sampling means comprising an outer longitudinal tubular member having an upper end and a lower end;

an inner longitudinal tubular member having an upper end and a lower end, said inner longitudinal tubular member being located within said outer longitudinal tubular member and being adapted to move longitudinally within said outer longitudinal tubular member, said lower end of said inner longitudinal tubular member having a plate attached thereto forming a flat surface essentially perpendicular to said inner longitudinal tubular member, said upper end of said inner longitudinal tubular member extending outside of said outer longitudinal tubular member;

a first positioning means perpendicularly connected to said upper end of said inner longitudinal tubular member;

and a second positioning means perpendicularly connected to said upper end of said outer longitudinal tubular member, said second positioning means being essentially parallel to said first positioning means, said first positioning means and said second positioning means being adapted to position said inner longitudinal tubular member within said outer longitudinal tubular member to form a cavity within said outer longitudinal tubular member for receiving a sample of soil, said cavity forming an adjustably predetermined volume, said first positioning means being connected to said second positioning means by an adjustable guiding member having a biasing element coacting therewith.

15. A soil sampling means in accordance with claim 14 wherein said adjustable guiding member comprises a threaded rod having fasteners attached at adjustable positions along said threaded rod to provide preset positioning of said first positioning means with respect to said second positioning means, said first positioning means and said second positioning means coacting with said inner longitudinal tubular member and said outer longitudinal tubular member respectively to form a cavity within said outer longitudinal tubular member having a predetermined volume.

16. A soil sampling means in accordance with claim 14 wherein said biasing element is a spring.

17. A soil sampling means in accordance with claim 15 wherein said fasteners comprise nuts.

* * * * *